US005168904A

United States Patent [19]

Quinkert

[11] Patent Number: 5,168,904

[45] Date of Patent: Dec. 8, 1992

[54] RECONFIGURABLE WIRING HARNESS JIG

[75] Inventor: Ronald M. Quinkert, Livonia, Mich.

[73] Assignee: Electro-Wire Products, Inc., Dearborn, Mich.

[21] Appl. No.: 781,731

[22] Filed: Oct. 23, 1991

[51] Int. Cl.[5] ..... B21F 27/12

[52] U.S. Cl. ..... 140/92.1; 29/755

[58] Field of Search ..... 140/92.1; 29/755, 850

[56] References Cited

U.S. PATENT DOCUMENTS

| | | | |
|---|---|---|---|
| 3,258,039 | 6/1966 | Ewalt | 29/755 |
| 3,653,411 | 4/1972 | Mosher et al. | 140/92.1 |
| 3,839,777 | 10/1974 | Puzio | 29/755 |
| 3,946,768 | 3/1976 | Fiorentino | 140/92.1 |
| 4,337,934 | 7/1982 | Caveney | 269/77 |
| 4,724,612 | 2/1988 | Pearson | 29/850 |
| 4,867,207 | 9/1989 | Crawford | 140/92.1 |
| 4,979,544 | 12/1990 | Swindlehurst | 140/92.1 |

*Primary Examiner*—Lowell A. Larson

*Attorney, Agent, or Firm*—Krass & Young

[57] ABSTRACT

A reconfigurable jig for assembling a wiring harness includes a number of fixture heads, each supportable in a variety of indexable positions and configurations by an adjustable post assembly which may be mounted in various configurations upon a perforated board.

14 Claims, 4 Drawing Sheets

LINE GUIDE HOLDER

LINE GUIDES

RECONFIGURABLE WIRING HARNESS JIG1.

Field of the Invention

This invention relates generally to wiring harnesses and more particularly to jigs for the fabrication of wiring harnesses. Most specifically, the invention relates to a wiring harness jig which may be reconfigured to accommodate the fabrication of a variety of different harness designs.

2. Background of the Invention

A wiring harness is comprised of a particularly configured bundle of electrical conductors utilized to provide electrical power to a variety of discrete components of an article of manufacture. Prefabricated wiring harnesses are very widely used in the manufacture of vehicles, since they eliminate the need for individual wires to be separately strung throughout the vehicle.

Electrical systems of motor craft have become more complicated and wiring harnesses have also increased in complexity and in many instances, it is desirable to include a three-dimensional wiring harness in a vehicle. A three-dimensional harness is one in which the various wires lie in different planes in a manner somewhat akin to the branching of a tree. This is in contrast to a flat, or two-dimensional harness.

Wiring harnesses are manufactured by stringing lengths of wire onto an appropriately configured jig and wrapping, binding or otherwise immobilizing the wires into a particular configuration. The jig, which may also be called a form board or pin board, includes a number of posts or other similar fixtures about which the wires are wrapped. The jigs are typically custom built by welding a number of appropriately shaped rods onto a supporting framework and the resultant jig is specific to one particular design of wiring harness. Such prior art jigs are individually built and problems of variation between jigs arise which can result in variability in the finished wiring harnesses made thereupon. As a result, each duplicate of a given jig is typically constructed on a master templet thereby occasioning problems associated with shipping and storage of the templet. Additionally, the custom nature of each jig, coupled with its fairly large size, necessitates a significant expenditure of resources in the manufacture and subsequent storage of the jigs.

It would be desirable to have a wiring harness jig which can be readily configured and reconfigured without the use of a templet so as to accommodate the manufacture of a variety of designs of wiring harness. The jigs should be relatively low in cost and accurately and readily reconfigurable. It is further desirable that any such jig be capable of use for the manufacture of both planar and three-dimensional harnesses.

Various reconfigurable wiring harness boards are known in the prior art; however, none of these prior art boards provide the features of the present invention. U.S. Pat. No. 3,653,411 discloses a reconfigurable pin board for the fabrication of wiring harnesses. The board includes predrilled holes arranged in a grid pattern and operates to hold simple pins in place for harness fabrication. The board is not capable of angularly positioning the pins and cannot be adapted for the fabrication of three-dimensional harnesses. U.S. Pat. No. 3,946,768 discloses a similar board which employs a wire mesh for retaining the pins. Accurate pin placement as well as angular positioning is not possible with this invention. U.S. Pat. No. 4,724,612 discloses a predrilled board used in combination with particularly configured pins. U.S. Pat. No. 4,867,207 discloses a reconfigurable harness fabrication board which includes a number of pop-up pins which may be manually or automatically released to provide a particular configuration. U.S. Pat. No. 4,979,544 discloses a harness fabrication board having pins lockable by a slide arrangement, and U.S. Pat. No. 4,337,934 discloses a post for use with a wiring harness jig, which post allows for the ready removal of wires therefrom.

None of the prior art references shows a wiring harness jig which is reconfigurable and which provides for angular positioning of the pins or angular positioning of fixture heads on the pins. The present invention provides for a reconfigurable wiring harness jig which employs standardized components and is capable of providing for the precise and repeatable angular adjustment of the various jig components. The present invention provides for the rapid configurations of a number of identical jigs which are rugged, reliable and which allow for the manufacture of three-dimensional wiring harnesses. These and other advantages will be readily apparent from the drawings, discussion and description which follow.

BRIEF DESCRIPTION OF THE INVENTION

There is disclosed herein a reconfigurable jig for assembling wiring harnesses. The jig includes a board having a top surface defining an x-y plane and further having a plurality of holes therein. The jig includes a post assembly which has a first end configured to fit into one of the holes so that a second end thereof projects above the x-y plane of the board. The jig further includes a fixture head supported on the second end of the post assembly. The post assembly and board are configured to provide for the angular indexing of the post assembly in the x-y plane of the board. The post assembly and fixture head are configured to provide for the angular indexing of the fixture head with regard to the post assembly.

In a particular embodiment, the post assembly comprises a post member and a separate insert member. The insert member includes the first end of the assembly and further includes a socket configured to receive and retain the post therein. In this particular embodiment, the insert member may further include a collar portion disposed proximate the first end. The collar assembly is configured to contact the board when the first end of the post assembly is fit into one of the holes. In another embodiment, the post assembly further includes a detent member associated therewith which engages the board so as to provide for the angular indexing of the post assembly. The detent member may comprise a detent washer, associated with the post assembly as well as a projection which engages an indentation in the board. The fixture head may comprise a wire guide, a clip holder or any other such fixture for fabrication of the wiring harness. The jig may further include an offset extender which may be positioned between the second end of the post assembly and the fixture head to spatially displace the fixture head from the post. In certain embodiments, the various components of the jig may be color coded or otherwise marked to indicate size, type and the like. In yet other embodiments the post assembly may comprise a drop post assembly which is operable to readily decrease the height at which the second end of the post assembly projects from the x-y plane of the board to facilitate removal of a wiring harness therefrom.

DETAILED DESCRIPTION OF THE INVENTION

The present invention comprises a jig which may be readily configured and reconfigured for the fabrication of a variety of differently designed wiring harnesses. The jig basically comprises a board used in combination with a post assembly which supports a number of guides, clips and other fixtures used for the fabrication of the wiring harness. The board and associated hardware are configured to be readily and accurately assembled into a variety of configurations.

Figure 1:
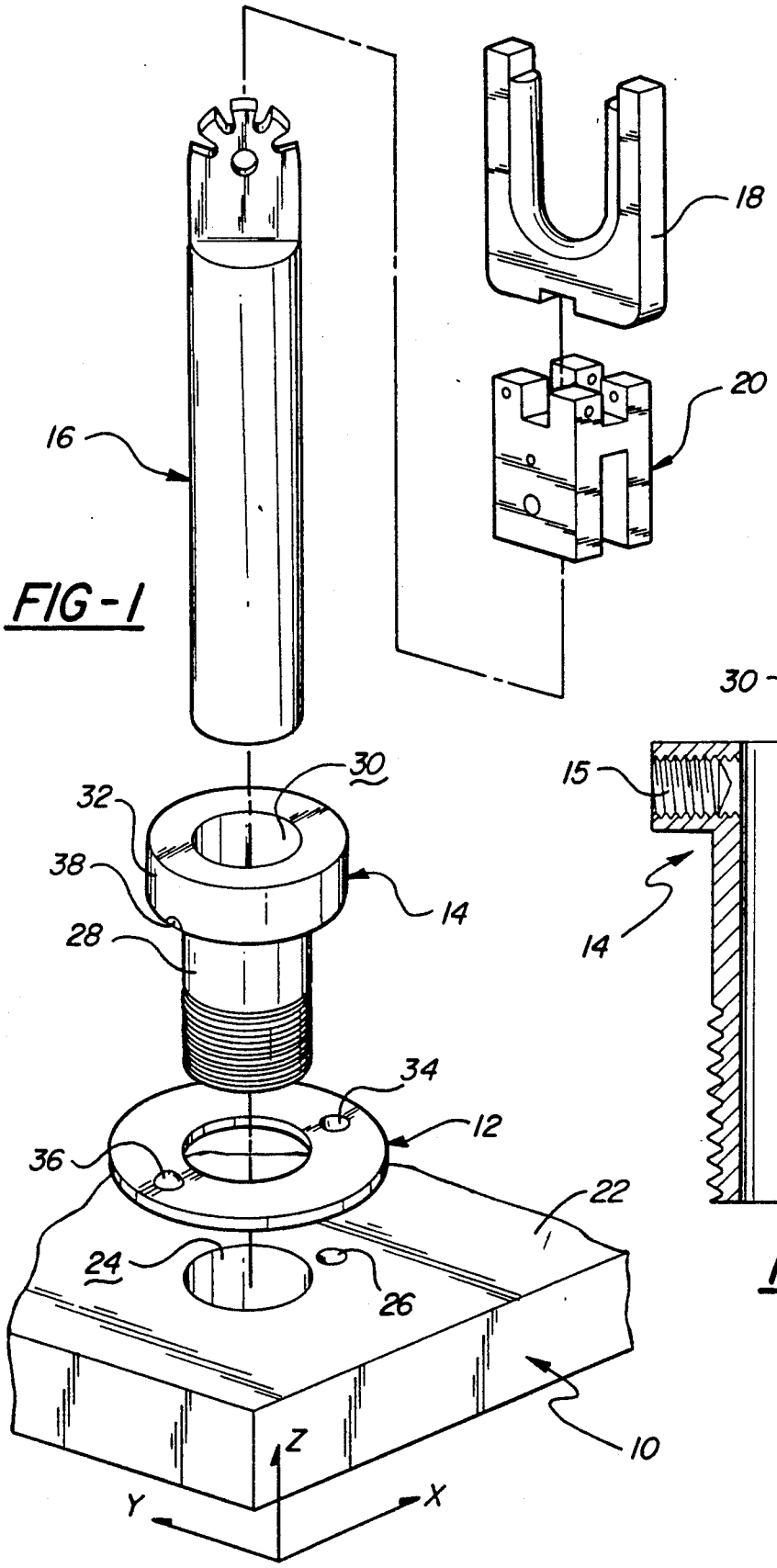
FIG. 1 is an exploded, perspective view of a portion of a wiring harness fabrication jig structured in accord with the principles of the present invention.

Referring now to FIG. 1 there is shown an exploded, perspective view of a portion of a wiring harness fabrication jig structured in accord with the principles of the present invention. Specifically illustrated in FIG. 1 is a portion of the board 10, a detent washer 12, an insert member 14, a post member 16 and a fixture head comprising a wire guide 18 and an associated wire guide holder 20.

In the illustrated embodiment it will be noted that the board 10 includes an upper surface 22 lying in, and defining, an x-y plane. The board includes a hole 24 defined therethrough and further includes an indentation 26 proximate the perimeter of the hole 24. The indentation 26 may extend all the way through the board or only part way therethrough. It is to be understood that in the illustration of FIG. 1, only a portion of the board 10 is shown and the board typically is fairly large and includes a number of holes 24, arranged in an evenly spaced pattern and each hole includes an indentation 26 associated therewith.

The illustrated jig further includes an insert member 14 which has a rod-like end 28 configured to be receivably retained in the hole 24. The insert member 14 includes a socket 30 defined therein, which socket is of a size configured to receive a post 16 therein and further includes a collar portion 32 disposed in a plane at generally right angles to the rod portion 28. The collar portion 32 is sufficiently large to prevent the insert member 14 from falling through the opening 24 in the board 10. As illustrated, the rod portion 28 of the socket is at least partially threaded and may optionally engage a corresponding nut (not shown) so as to affix it to the board 10.

The jig further includes a detent washer 12, which in use is interposed between the insert member 14 and the board 10. The detent washer 12 is typically a thin member and includes two projecting portions 34,36 angularly disposed from one another proximate the outer periphery of the washer. A first one of the projections 34 projects downward, i.e., away from the collar 32 of insert member 14 in the Z direction of the board 10 and is configured to engage the indentation 26 in the board 10. A second projection 36 is configured to project upwards, i.e., in the direction of the collar 32 of the insert member 14 and this projection 36 is configured to engage a corresponding indentation 38 in the collar 32.

Figure 2:
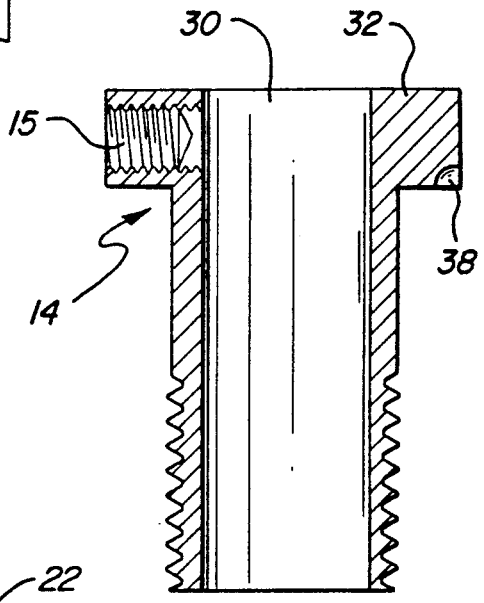
FIG. 2 is a cross-sectional view of an insert member for use in the present invention.

Referring now to FIG. 2, there is shown a cross-sectional view of an insert member 14, better illustrating the indentation 38 in the collar portion 32 thereof and also illustrating the socket portion 30. As illustrated, the insert 14 includes a set screw 15 which engages and supports the post member. Alternatively, the socket may be configured to include a closed bottom which supports the post member.

The combination of the detent washer 12, the insert member 14 and the board 10 provide for angular indexing of the insert member 14, and hence the post 16 retained therein, in the x-y plane of the board. It is to be understood that by angular indexing is meant that the insert 14 and post 16 may be rotated in the hole 24 through a precise and repeatable angular displacement. It will be appreciated that in the illustrated embodiment, the detents 34 and 36 on the detent washer 12 engage the corresponding indentations 26 and 38 in the board 10 and insert 14. By changing the angular relationship of the detents 34 and 36, the degree of rotation of the insert 14 may be selected.

Figure 3A:
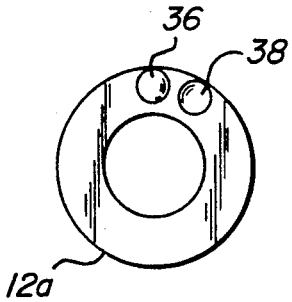
FIG. 3A is a top plan view of a first configuration of detent washer.
Figure 3B:
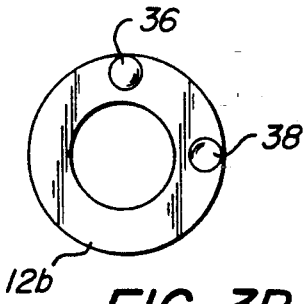
FIG. 3B is a top plan view of a second configuration of detent washer.
Figure 3C:
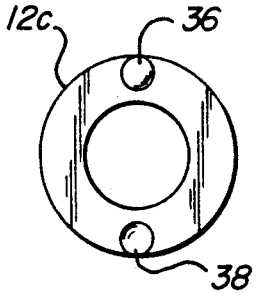
FIG. 3C is a top plan view of a third configuration of detent washer.

Referring now to FIGS. 3A–3C there are illustrated three different configurations of detent washer 12*a*–12*c* characterized in that the detents 36,38 formed thereupon have different angular displacements. In FIG. 3A the detents 36,38 are separated by approximately 30 degrees; in FIG. 3B they are separated by approximately 90 degrees and in FIG. 3C they are separated by approximately 180 degrees. Clearly, other spacing may be employed to provide for a wide range of angular indexing in the x-y plane of the board. It is contemplated within the scope of the present invention that other mechanical configurations may be employed to achieve the indexing in the x-y plane of the board. For example, the hole 24 may be configured as a polygonal shape and the rod portion 28 of the insert 14 may be similarly configured to fit the polygonal hole and indexing may be achieved by rotation of the shaped rod in the hole. For example, if the hole were octagonal and the rod of corresponding shape, 45 degree indexing could be achieved. Indexing in the x-y plane could similarly be achieved by appropriately configuring the post 16 and socket 30 and by immobilizing the insert 14 from rotation in the board as, for example, by the use of guide pins. Similarly, indexing in the x-y plane could be achieved by eliminating the washer and providing a detent member associated with one of either the board 10 or insert 14 and a series of spaced apart detent engaging indentations with the other. All of the foregoing, as well as equivalents, are within the scope of the present invention.

The jig includes a post 16 disposed within the insert 14. It is to be understood that the present invention also contemplates forming the post and insert as a single, unitary member. Within the scope of this disclosure, the post 16 and insert 14 (whether separate or unitary) as well as the detent washer 12 (or equivalent structure) are collectively referred to as the "post assembly."

Affixed to the top of the post 16 is a fixture head, which in this instance is illustrated as including a U-shaped wire guide 18 and a mounting block 20 which cooperates with the post 16 to achieve angular indexing relative to the center line of the post. By angular indexing of the head relative to the post assembly is meant that the wire guide 18 may be mounted with its center line either parallel to the center line of the post 16 or at a precisely selected angular relationship thereto.

Figure 4A:
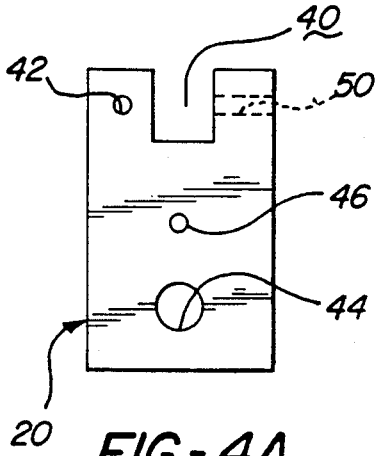
FIG. 4A is a front elevational view of a line guide holder.
Figure 4B:
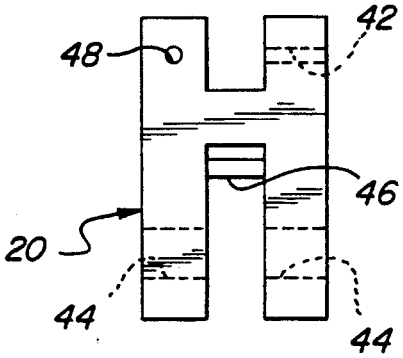
FIG. 4B is a side elevational view of the line guide holder of FIG. 4A.

Referring now to FIGS. 4A and 4B there are shown front and side elevational views respectively of the mounting block 20. As shown in FIG. 4A, the block 20 includes a first notch portion 40 which supports a wire guide therein. The block 20 further includes a first affixation hole 42 proximate the notch portion for affixing the wire guide thereinto as will be described in greater detail hereinbelow and further includes a mounting hole 44 through the base thereof for mounting the block 20 to the post 16. The block 20 further includes a retaining pin 46, one end of which is visible in this figure. FIG. 4B is a side elevational view of the same block 20 better illustrating the pin 46 and showing the first affixation hole 42 and mounting hole 44 in phantom outline and further illustrating a second affixation hole 48.

Figure 5:
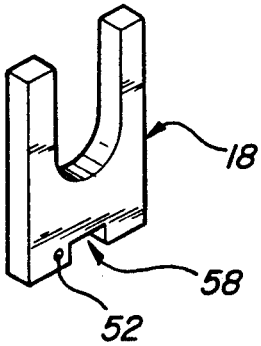
FIG. 5 is a perspective view of one configuration of line guide.
Figure 6:
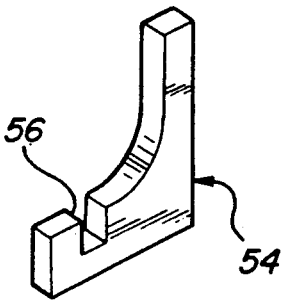
FIG. 6 is a perspective view of another configuration of line guide.

FIG. 5 illustrates one configuration of wire guide 18 of the present invention. This guide is a U-shaped member which includes an affixation hole 52 proximate the base thereof. In use, the guide 18 is fitted into a mounting block such as the block 20 of FIG. 4A, and the affixation hole 52 is aligned with one of the affixation holes in the block such as hole 42, and the two are affixed by a screw, pin or similar member. The combination of the affixation holes and the notch retains the guide 18 in the block. FIG. 6 illustrates a half guide 54 which may be used in combination with the guide 52 of FIG. 5. The half guide includes a notched portion 56 which engages the notch 58 in the full guide of FIG. 5 so as to form a guide having three separate arms disposed in a right angular relationship.

Figure 7A:
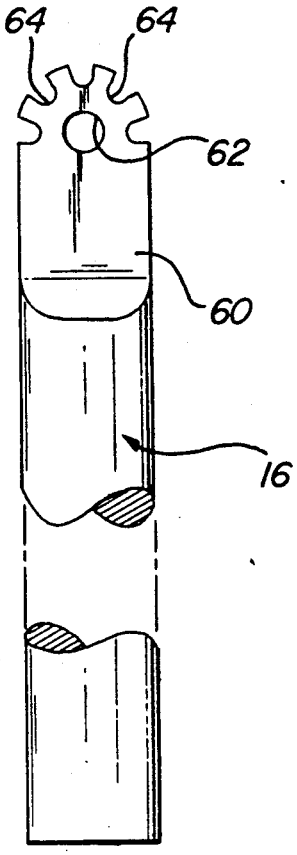
FIG. 7A is a front elevational view of the first embodiment of a post of the present invention.
Figure 7B:
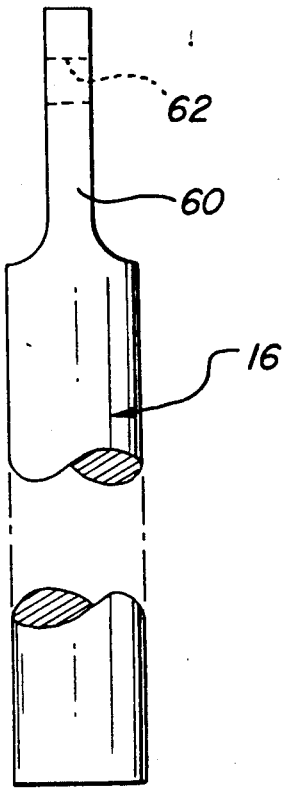
FIG. 7B is a side elevational view of the post of FIG. 7A.

Referring now to FIG. 7A and 7B there is shown one particular configuration of post 16 which may be employed in the present invention. FIG. 7A is a front elevational view of the post 16 and it will be noted that the post includes shaft having a head portion 60 at one end thereof. The head portion includes a hole 62 therethrough and further includes a series of notches 64 arrayed therealong. The notches 64 are evenly spaced at approximately 45 degree intervals with regard to the central hole 62. FIG. 7B is a side view of the post 16 of FIG. 7A.

In use, the post 16 engages the fixture head, and in the FIG. 1 embodiment engages the mounting block portion 20 of the fixture head. With regard to FIGS. 1 and 4 it will be appreciated that in use, the mounting block 20 is affixed to the post 16 by means of a screw, pin, nut and bolt combination, or similar means, passing through the mounting hole 44 in the mounting block 20 and through the corresponding central opening 62 in the post. The retaining pin 46 in the block 20 engages one of the notches 64 to rigidly attach the block 20 to the post 16. By selecting the appropriate notch, the block 20 may be angularly indexed with regard to the post at intervals corresponding to the 45 degree integrals of the notches. Clearly, the degree of angular indexing may be varied by varying the spacing of the notches.

Figure 8:
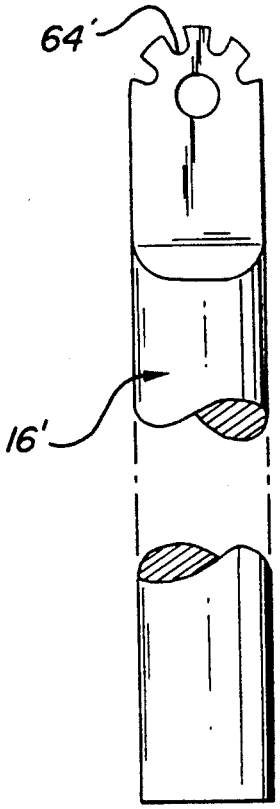
FIG. 8 is a front elevational view of another configuration of post.

Referring now to FIG. 8 there is shown another configuration of post 16' which is generally similar to that of FIGS. 7A and 7B with the exception that the notches thereof 64', while disposed at 45 degree integrals relative to one another begin, not at the center line of the post but at an offset of 22.5 degrees thereto. It will be appreciated that a fine degree of control over the degree of indexing may be achieved by using the appropriate one of the posts. While both posts include 45 degree gradations of indexing, the gradations are offset with regard to one another and hence 22.5 degree control of indexing is readily achieved. Obviously, this principle may be readily expanded to achieve still finer control of indexing.

Figure 9:
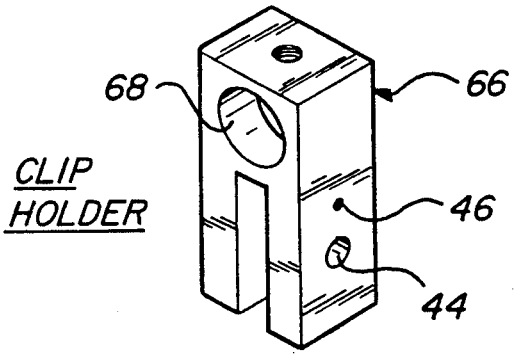
FIG. 9 is a perspective view of a clip holder for use in the present invention.

While the foregoing description has primarily described the placement of wire guides atop the post portion of the fixture assembly, a wide variety of other types of jig hardware may be similarly mounted. For example, FIG. 9 illustrates a clip holder 66 which may be directly mounted atop the post. The clip holder 66 includes a hole 44 therethrough and a pin 46 generally similar in form and function to those in the mounting block. The clip holder 66 further includes a particularly configured opening 68 for retaining wiring harness clips. Other hardware may be similarly mounted.

Figure 10:
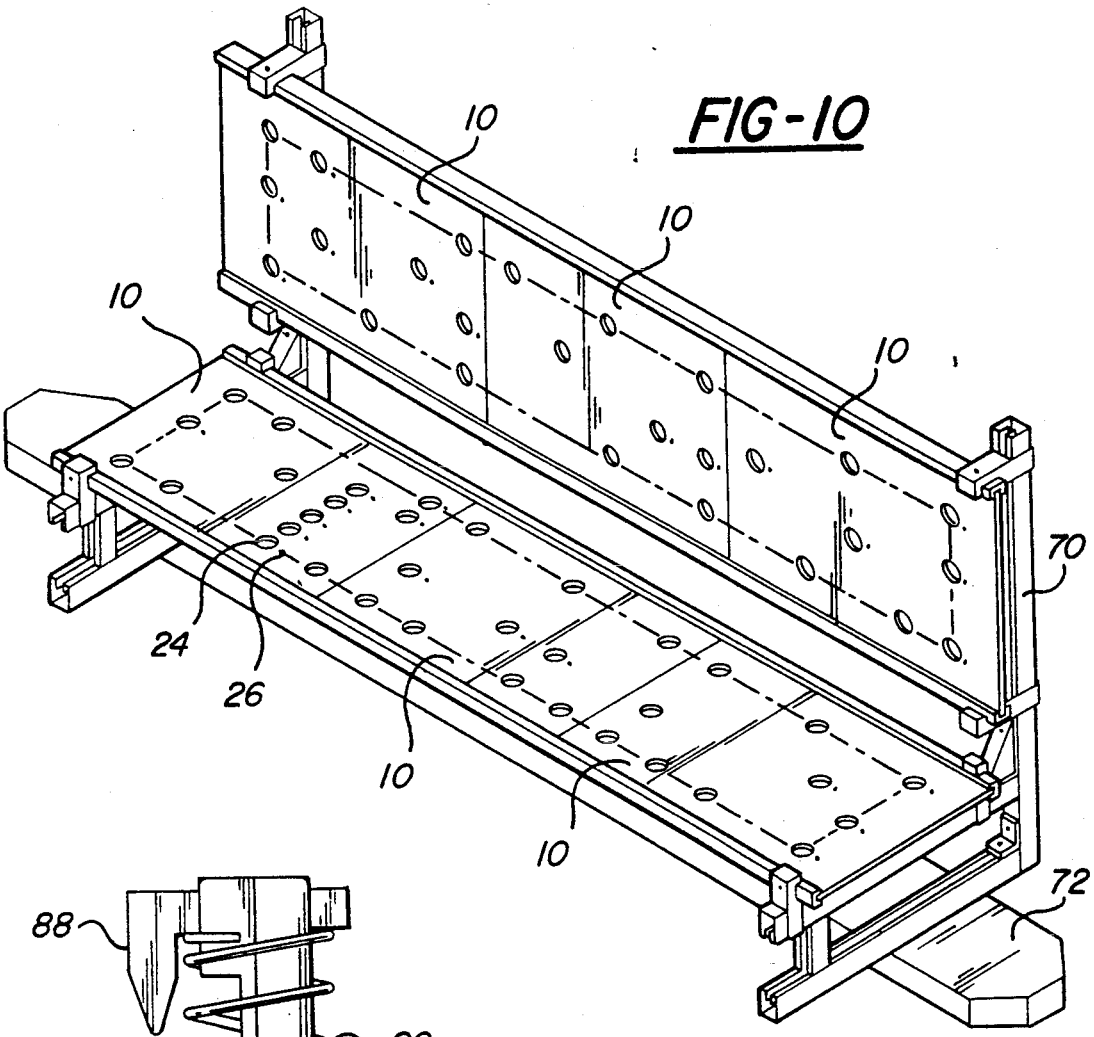
FIG. 10 is a perspective view showing several of the boards employed in the harness fabrication system of the present invention as mounted on an adjustable support framework.

In FIG. 1, only a small portion of the board 10 has been illustrated; however, in use, a relatively large board is typically employed. The present invention is advantageously utilized with boards of any size and orientation. FIG. 10 illustrates one typical board arrangement which may be employed for the fabrication of vehicular wiring harnesses. The FIG. 10 embodiment illustrates a series of six boards 10 mounted in two groups of three disposed at right angles to one another. The boards 10 are retained by an adjustable framework 70 and are supported by a conveyor 72. It will be noted that each of the boards 10 includes a number of holes 24 therein, each with a corresponding indentation 26. In the illustrated embodiment, the holes are shown arranged in a right-angled matrix configuration although it is to be appreciated that they could be mounted in a series of staggered rows or in any other such configuration. In use, post assemblies are inserted into appropriate holes and angularly adjusted to properly position various fixture heads for the fabrication of a particular wiring harness. The use of right angled boards greatly facilitates harness fabrication by permitting the easy assembly of three-dimensional and other complicated wiring structures.

Figure 11:
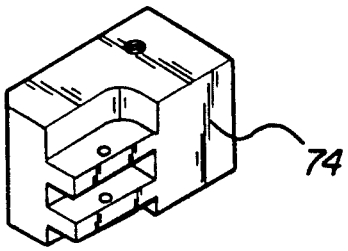
FIG. 11 is a perspective view of an offset member for use with the system of the present invention.

The present invention, as heretofore described, provides for a high degree of selectivity and accuracy in the positioning of the fixture heads; however, in some instances, it may be desirable to position a fixture head at a location intermediate the holes 24 in the boards 10 and in such instances an offset member may be employed. FIG. 11 depicts one such offset member 74. This member is basically an extender which mounts onto the post in a manner similar to a fixture head and includes mounting hardware for attaching a fixture head thereto. By the appropriate use of extenders and by relying upon the angular indexing of the hardware of the present invention, a virtually infinite series of configurations of harness jig may be established.

In accord with another feature of the present invention, the post assembly is configured as a drop post to facilitate removal of a finished wiring harness therefrom. The drop post is typically locked at a preselected position so that the post projects from the board at an appropriate, angularly indexed position as previously described; however, when harness fabrication is complete, the drop post is activated so that the post portion of the post assembly falls at least part way through the board so as to quickly lower the fixture head away from the completed wiring harness.

Figure 12A:
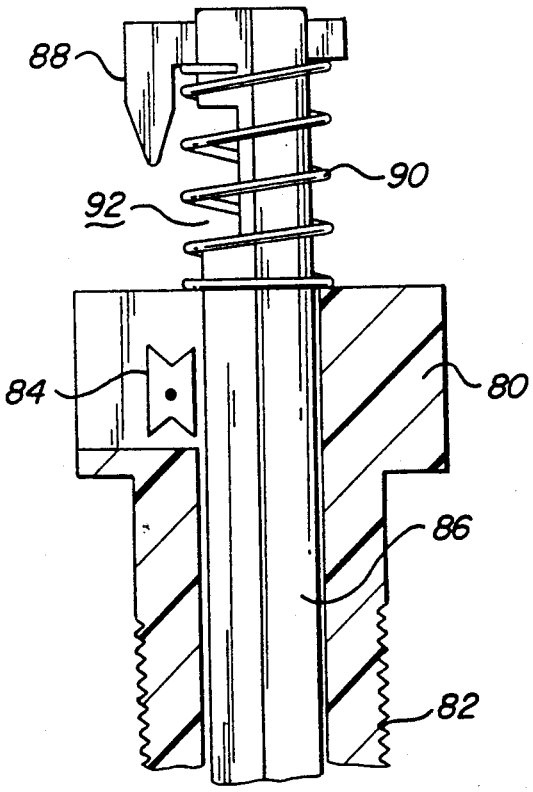
FIG. 12A is a cross-sectional view of a portion of a drop post assembly shown in its dropped position.
Figure 12B:
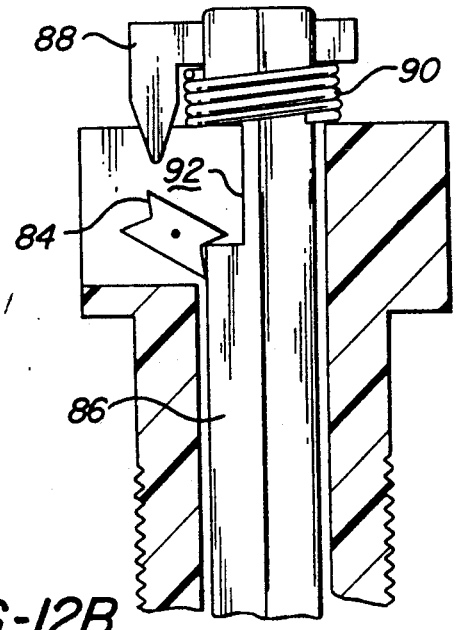
FIG. 12B is a cross-sectional view of the drop post assembly of FIG. 12A shown in its extended position.

There are number of drop post arrangements which may be employed in the present invention. For example, the insert member 14 in FIG. 1 may include a quick release screw, pin or similar member therein for retaining the post. Activation of the quick release will cause the post to drop within the insert member. One particular design of drop post mechanism is illustrated in FIGS. 12A and 12B. This mechanism provides for a quick and positive latching and unlatching of the post and may be activated by one hand. FIG. 12A is a cross-sectional depiction of the mechanism in its unlatched, i.e., dropped, state and FIG. 12B is a cross-sectional view of the mechanism in its locked state. As illustrated, the drop post mechanism includes a housing 80 configured to fit into a support board such as that illustrated at 10 in FIG. 1. The housing 80 includes a threaded portion 82 for affixation of the assembly to the board. The drop post assembly includes a latching cog 84 mounted to freely rotate within a cut-away portion of the housing 80, and including a notch at either end thereof. The assembly also includes a post member 86 having a latching finger 88 on one end thereof and a spring 90, or similar biasing means disposed between the latching finger 88 and the housing 80. It is notable that the post 86 includes a cut-away portion 92 in the region of the finger 88. The latching cog is disposed so as to be contacted and rotated by the latching finger 88 so as to cause one of the notches to engage the cut-away portion of the post 86.

In FIG. 12B, the drop post is shown in its latched position. It will be noted that the latching cog 84 is rotated into engagement with a corner of the cut-away portion 92 of the post 86. The spring 90 biases the post 86 and housing 80 apart and serves to keep tension on the latching cog 84. The fact that the cog 84 is pivotally attached to the housing prevents it from moving away and the notched arrangement therein cooperates with the cut-away portion 92 of the post 86 to firmly wedge the post in place. Unlatching of the assembly is accomplished by biasing the post 86 in a downward direction so as to bring the latching finger 88 in contact with the latching cog 84. At this time, the corner of the cut-away portion 92 of the post is away from the region of the latching cog 84 and the cog is therefore free to rotate. The finger 88 rotates the cog 84 in a counter-clockwise direction as viewed in FIG. 12B and tilts the notch in the cog 84 away from the post. Once it is released from the cog, the post is free to move to the position illustrated in FIG. 12A and in so doing it pushes the cog 84 to the configuration shown in FIG. 12A, thereby allowing the post to drop.

It is to be noted that in the practice of the present invention, the drop post assembly will typically be mounted so that the latching finger 88 and spring 90 are beneath the surface of the board so that when the post drops, the length thereof will fall beneath the board. Clearly other arrangements of drop posts may be employed in the practice of the present invention.

The jig fabrication system of the present invention may be manufactured from a wide variety of materials. The board is typically prepared from a lightweight material such as wood, synthetic polymers, fiber board materials, composites and the like although it should be understood that the board could similarly be manufactured from metals and the like. The detent washer, inserts, posts and various mounting hardware are most advantageously manufactured from metals or high durability polymers as well as combinations thereof. The various members of the system are preferably coded by color or other indicia to indicate their size, angular orientation and the like. By the use of marked components, an appropriate wiring harness jig may be easily configured through a simple set of directions by selecting appropriate components, placing them in specified holes and adjusting them according to specification. By so doing, a series of identical and accurate jigs may be easily assembled without resort to a templet or other such assembly hardware.

The present invention is directed to an accurate, highly adjustable, and reconfigurable jig for the assembly of wiring harnesses. The jig includes a number of post assemblies which support the various fixture heads required for harness fabrication. The jig is highly adjustable with regard to the angular position of the fixture head. Additionally, the plurality of holes in the board and the use of offset members allows for positioning of the adjusted fixture heads at any location in the plane of the board.

The foregoing drawings, discussion, description and figures are merely meant to illustrate particular embodiments of the present invention and are not meant to be limitations upon the practice thereof. Clearly, many other variations are possible within the scope of the present invention. For example, while various mechanical arrangements for achieving the adjustability in the various planes were described, other equivalents adjustment of the structures such as compression fittings, grooved engagement members, set screws and the like will be readily apparent to one of skill in the art and such embodiments are all within the scope of the present invention. It is the following claims, including all equivalents, which define the scope of the invention.

I claim:

1. A reconfigurable jig for assembling a wiring harness comprising:

a board including a top surface defining an x-y plane and having a plurality of holes defined therein;

a post assembly having a first end configured to fit into one of said holes so that a second end thereof projects above the x-y plane of said top surface; and a fixture head supported on the second end of said post assembly;

said post assembly and board being configured to provide for the angular indexing of the post assembly in the x-y plane of said board and said post assembly and fixture head being configured to provide for the angular indexing of said head with regard to the post assembly.

2. A jig as in claim 1, wherein said post assembly comprises a post member and a separate insert member, a portion of said insert member defining the first end of said assembly and being configured to receive and retain the post therein.

3. A jig as in claim 1, wherein said post assembly includes a collar portion disposed proximate the first end thereof, said collar portion configured to contact the board when the first end of the post assembly is fit into one of said holes.

4. A jig as in claim 1, wherein one of said post assembly and board includes a detent member associated therewith and the other of said post assembly and board includes a detent engaging member associated therewith, said detent member and detent engaging member being configured to provide for the angular indexing of the post assembly in the x-y plane of the board.

5. A jig as in claim 4, wherein said detent member comprises a projecting member associated with the post assembly and the detent engaging member comprises an indentation in said board disposed proximate at least one of said holes, said indentation being configured to receive said projecting member.

6. A jig as in claim 5, wherein said post assembly includes a detent washer and said projecting member is disposed o the detent washer.

7. A jig as in claim 1, wherein said post assembly comprises a drop post assembly selectably operable to decrease the height which the second end thereof projects above the x-y plane of said top surface, so as to facilitate removal of a wiring harness from the fixture head supported by said second end.

8. A jig as in claim 1, wherein said fixture head comprises a wire guide for supporting a bundle of wires therein.

9. A jig as in claim 1, further including an offset extender disposed between the second end of said post assembly and the fixture head.

10. A jig as in claim wherein said post assembly includes indicia thereupon corresponding to the height thereof.

11. A jig as in claim 10, wherein said indicia comprise a color coding.

12. A jig as in claim 1, wherein said fixture head includes indicia thereupon indicative of a physical parameter of said head.

13. A jig as in claim 12, wherein said indicia comprise a color coding.

14. A reconfigurable jig for assembling a wiring harness comprising:

a board including a top surface defining an x-y plane and having a plurality of similarly sized holes defined therein and further including an indentation on said top surface proximate each of said holes;

a detent washer including a projection configured to engage said indentation;

an insert member having a rod portion configured to fit into one of said holes, a collar portion which is larger than said holes and which is disposed in a plane at right angles to the rod portion and which includes means for engaging said detent washer, said insert further including a socket portion;

a post having a first end configured to fit into said socket; and a fixture head indexably retained on a second end of said post so that said fixture head is angularly adjustable with regard to said post.

* * * * *